US010280620B2

(12) United States Patent
Eilola

(10) Patent No.: US 10,280,620 B2
(45) Date of Patent: May 7, 2019

(54) METHOD AND APPARATUS FOR CASTING PREFABRICATED PRESTRESSED CONCRETE PRODUCTS

(71) Applicant: Elematic Oyj, Akaa (FI)

(72) Inventor: Jani Eilola, Lempaala (FI)

(73) Assignee: ELEMATIC OYJ, Akaa (FI)

( * ) Notice: Subject to any disclaimer, the term of this patent is extended or adjusted under 35 U.S.C. 154(b) by 380 days.

(21) Appl. No.: 14/842,890

(22) Filed: Sep. 2, 2015

(65) Prior Publication Data

US 2016/0060868 A1 Mar. 3, 2016

(30) Foreign Application Priority Data

Sep. 2, 2014 (FI) ..... 20145760

(51) Int. Cl.

| | |
|---|---|
| ***E04C 5/08*** | (2006.01) |
| ***E04C 2/06*** | (2006.01) |
| ***B28B 23/04*** | (2006.01) |
| ***E04G 21/12*** | (2006.01) |

(52) U.S. Cl.

CPC ..... *E04C 5/08* (2013.01); *B28B 23/043* (2013.01); *E04C 2/06* (2013.01); *E04G 21/12* (2013.01)

(58) Field of Classification Search

CPC ..... E04C 5/08

See application file for complete search history.

(56) References Cited

U.S. PATENT DOCUMENTS

| | | | |
|---|---|---|---|
| 3,488,816 | A | 1/1970 | Garaboux |
| 3,577,613 | A | 5/1971 | Hidden |

FOREIGN PATENT DOCUMENTS

| | | | |
|---|---|---|---|
| CH | 103089018 | a | 5/2013 |
| CN | 102943434 | A | 2/2013 |
| CN | 202826047 | U | 3/2013 |
| CN | 103255877 | A | 8/2013 |
| CN | 103452035 | A | 12/2013 |
| CN | 103485478 | A | 1/2014 |
| DE | 232519 | A1 | 1/1986 |
| JP | H05345312 | A | 12/1993 |
| JP | 2001179724 | A | 7/2001 |
| JP | 2002257654 | A | 9/2002 |
| SU | 750021 | A1 | 7/1980 |
| WO | 2011115493 | A1 | 9/2011 |

OTHER PUBLICATIONS

Office Action cited in priority application FI 20145760 dated Sep. 2, 2014.

Chinese Patent Office, Search report dated Jul. 18, 2018 in the corresponding Chinese patent application No. 201510664840.2.

*Primary Examiner* — Larry W Thrower

(74) *Attorney, Agent, or Firm* — Berggren LLP

(57) ABSTRACT

A method and an apparatus for casting prefabricated prestressed concrete products with a substantially horizontal slipform casting process, in which method reinforcement strands are stressed in a bundle on a casting bed before the slipform casting is started, wherein the expected behavior of at least one measurable variable affecting the strand stressing process during the strand stressing process is predetermined, and the behavior of the at least one measurable variable is measured and compared to its predetermined expected behavior during the strand stressing process.

5 Claims, 3 Drawing Sheets

METHOD AND APPARATUS FOR CASTING PREFABRICATED PRESTRESSED CONCRETE PRODUCTS

This application claims benefit of Finnish Patent Application No. 20145760, filed 2 Sep. 2014, the contents of which are incorporated herein by reference in their entirety for all purposes.

BACKGROUND

1. Field

The present disclosure relates to casting prefabricated prestressed concrete products, such as slipform cast concrete products. More precisely the present disclosure relates to stressing of the prestressed reinforcement strands in the casting process.

2. Description of Related Art

Prefabricated concrete elements, such as hollow-core slabs and solid concrete slabs, are conventionally cast by slipform casting on long casting beds as a continuous casting process. The length of said continuous casting process is defined either on the basis of the total length of the elements to be cast, or on the basis of the maximum length of the casting bed. The length of casting beds used in slipform casting can be from 50-60 m up to 150-200 m, depending on the size of the element plant. When a slipform casting equipment has cast a continuous slab on a casting bed, the cast concrete slab is allowed to be cured on the casting bed. After the concrete mass has cured, the uniform cast element is cut, generally by sawing, into pieces with predetermined lengths on the basis of the design characteristics of the ready-made elements, and the cut concrete elements are lifted off the casting bed to storage, to wait for transportation to their appointed targets of usage.

Generally concrete elements cast by slipform casting are prestressed, i.e. they are provided with prestressed reinforcement strands. These reinforcement strands are prestressed by pulling the strands to a predefined stress before starting of the actual slipform casting with a suitable slipform casting machine.

The stressing of reinforcement strands may be carried out strand by strand, or in a bundle, where all of the required reinforcement strands are connected to a single strand pulling plate after which the plate is moved a predetermined distance with a bundle stressing device in order to achieve the required stressing of the reinforcement strands.

The problem with this bundle-type stressing of the reinforcement strands is whether proper stressing is achieved to all of the strands in bundle. Correct stressing of the reinforcement strands greatly affects the properties of the cast concrete slab, especially in view of the load bearing capacity of the slab.

SUMMARY

The present disclosure provides a solution for controlling and following the stressing process of the reinforcement strands in order to guarantee substantially correct stressing of the reinforcement strands in a bundle stressing, and allows for a quick detection of deviations in the stressing process due to incorrect reinforcement strand amounts, loose stands or other causes. This increases the quality of the products to be cast and allows restarting of the stressing process without the need to change the reinforcement strands of the bundle when problems in the stressing process are detected early on.

In the method of an embodiment of the invention for casting prefabricated prestressed concrete products with a substantially horizontal slipform casting process, reinforcement strands are stressed in a bundle on a casting bed before the slipform casting is started, and the expected behavior of at least one measurable variable affecting the strand stressing process during the strand stressing process is predetermined, and the behavior of the at least one measurable variable is measured and compared to its predetermined expected behavior during the strand stressing process.

The behavior of at least one measurable variable means in this context the way in which the variable evolves and changes when the strand stressing process proceeds.

The predetermination of the expected behavior of the at least one measurable variable affecting the strand stressing process may be carried out by implementing Hooke's law, for example. Thereby the at least one measurable variable is advantageously a force exerted in the strand stressing process, an elongation of the reinforcement strand bundle, and/or any other measurable variable which can be used to determine either the force or the elongation.

Further, in the predetermination of the expected behavior of the at least one measurable variable amount and type of reinforcement strands in the bundle may be used.

In the method of an embodiment of the invention the stressing process is advantageously controlled with an automatic control system implementing the predetermination of the expected behavior of the at least one measurable variable and/or the measuring of the behavior of the at least one measurable variable during strand stressing process. The automatic control system is preferably also a part of a production control system of the manufacturing facility, or directly connected to it.

In the method of an embodiment of the invention the automatic control system advantageously also issues alert and ends the stressing process and may also release the stress affecting the reinforcement strand bundle when the measured at least one measurable variable deviates from the predetermined expected behavior of the at least one measurable variable more than predetermined amount during the stressing process.

The apparatus of an embodiment of the invention for casting prefabricated prestressed concrete products with a substantially horizontal slipform casting process comprises a casting bed, and a bundle stressing device for stressing reinforcement strands in a bundle on the casting bed, wherein the bundle stressing device comprises a device for measuring behavior of at least one measurable variable affecting the strand stressing process during the strand stressing process and for comparing the measured behavior to a predetermined expected behavior of the at least one measurable variable during the strand stressing process.

In the apparatus of an embodiment of the invention, the said device may advantageously comprises means for predetermining the expected behavior of the at least one measurable variable.

The apparatus of an embodiment of the invention may advantageously comprise an automatic control system for controlling the operation of the bundle stressing device based on information obtained from the said device.

The apparatus of an embodiment of the invention may also comprise means for issuing alerts based on information obtained from the said device.

The apparatus of an embodiment of the invention may also comprises means for saving data relating to the measured behavior of the at least one measurable variable. This can be done by the automatic control system to a suitable database, which database may be external. This allows for verification of proper stressing of the reinforcement strand bundle for each prestressed cast product.

The features defining a method according to an embodiment of the present invention are dis-closed more precisely as a method for casting prefabricated prestressed concrete products with a substantially horizontal slipform casting process, in which method reinforcement strands are stressed in a bundle on a casting bed before the slipform casting is started, characterized in that the expected behavior of at least one measurable variable affecting the strand stressing process during the strand stressing process is predetermined, and the behavior of the at least one measurable variable is measured and compared to its predetermined expected behavior during the strand stressing process. The features defining an apparatus ac-cording to an embodiment of the present invention are disclosed more precisely as an apparatus for casting prefabricated prestressed concrete products with a substantially horizontal slipform casting process, which apparatus comprises a casting bed, and a bundle stressing device for stressing reinforcement strands in a bundle on the casting bed, characterized in that the bundle stressing device comprises a device for measuring behavior of at least one measurable variable affecting the strand stressing process during the strand stressing process and for comparing the measured behavior to a predetermined expected behavior of the at least one measurable variable during the strand stressing process.

Other advantageous embodiments and features of the invention include: an embodiment wherein the at least one measurable variable include a force exerted in the strand stressing process, an elongation of the reinforcement strand bundle, and/or any other measurable variable which can be used to determine either the force or the elongation; an embodiment wherein in the predetermination of the expected behavior of the at least one measurable variable amount and type of reinforcement strands in the bundle are used; an embodiment wherein the stressing process is controlled with an automatic control system implementing the predetermination of the expected behavior of the at least one measurable variable and/or the measuring of the behavior of the at least one measurable variable during strand stressing process, which automatic control system is preferably a part of a production control system of the manufacturing facility; an embodiment wherein the automatic control system issues alert and ends the stressing process and/or releases the stress affecting the reinforcement strand bundle when the measured at least one measurable variable deviates from the predetermined expected behavior of the at least one measurable variable more than predetermined amount during the stressing process; an embodiment wherein the said device comprises means for predetermining the expected behavior of the at least one measurable variable; an embodiment wherein the apparatus comprises an automatic control system for controlling the operation of the bundle stressing device based on information obtained from the said device; an embodiment wherein the apparatus comprises means for issuing alerts based on information obtained from the said device; and an embodiment wherein the apparatus comprises means for saving data relating to the measured behavior of the at least one measurable variable.

BRIEF DESCRIPTION OF DRAWINGS

Next the invention, in its embodiments, is discussed in greater detail in the sense of example and with reference to accompanying drawings, where.

BRIEF DESCRIPTION OF SPECIFIC EMBODIMENTS

Figure 1:
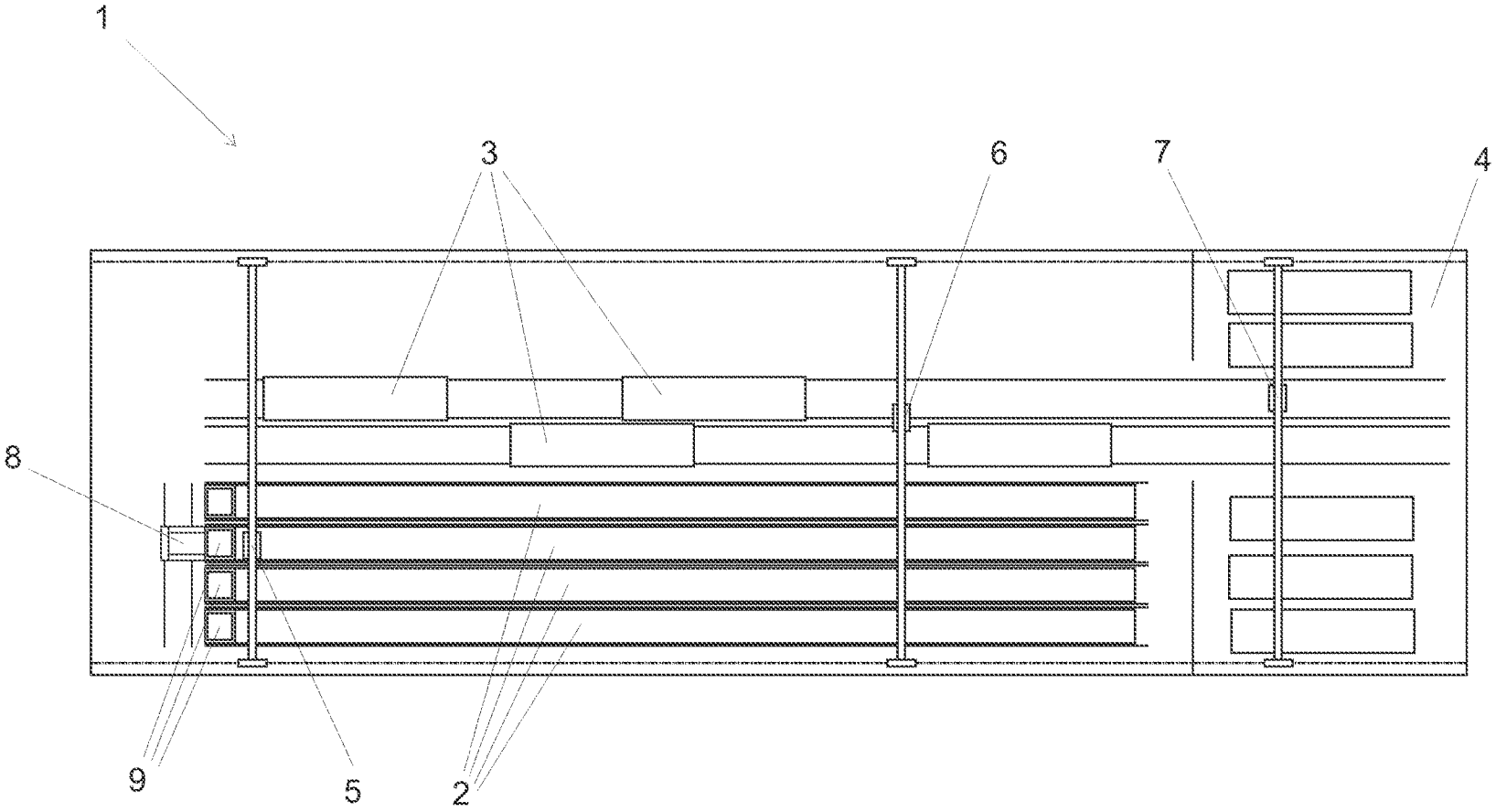
FIG. 1 shows schematically a layout of a manufacturing facility for prefabrication of prestressed concrete products in accordance with an embodiment of the present invention.

FIG. 1 shows schematically a layout of a manufacturing facility 1 for prefabrication of prestressed concrete products, in which an embodiment of the present invention is used.

The manufacturing facility 1 shown in FIG. 1 comprises a plurality of slipform casting beds 2, a plurality of transfer beds 3 for moving cut hollow-core concrete products to a storage area, a storage area 4, bridge cranes 5, 6, 7 for lifting and transferring cast concrete products and casting equipment, and a bundle stressing device 8.

When new casting process is to be started, the casting beds 2 are generally first cleaned and oiled, after which reinforcements strands are pulled on the lengths of the casting beds and the ends of the reinforcement strands located on the same casting bed are fixed to a strand pulling plate to form a reinforcement strand bundle. The strand pulling plate is connected after fixing of the reinforcement strands to a bundle stressing device 8.

Next the stressing process is started, where the bundle stressing machine 8 starts to stress the reinforcement strands by pulling the strand pulling plate with hydraulic cylinders. The start of the stressing process is generally accompanied with warning lights and sounds to inform the personnel to stay clear of the area. Once the stressing of the reinforcement strands is carried out to the required stress with the bundle stressing device 8, the strand pulling plate is fixed to a mechanical fixing structure 9 located at the end of each casting bed 2, after which the strand pulling plate is detached from the bundle stressing device, so that the bundle stressing device can be moved along transverse rails to the end of another casting bed for a new stressing process.

After the ends of the reinforcement strands are fixed to the strand pulling plate and the strand pulling plate is connected to the bundle stressing device 8, the strand pulling plate may be pulled a short distance before starting the actual stressing of the reinforcement strands. This short pull, which can be 20 cm for example, will remove slack from the reinforcement strands and reduce the risk of uneven stressing of the reinforcement strands.

After the stressing process is done, the slipform casting process is started by lifting a slipform casting machine on the casting bed and over the reinforcement strands, and by transferring concrete mass to the mass container of the slipform casting machine.

Figure 2:
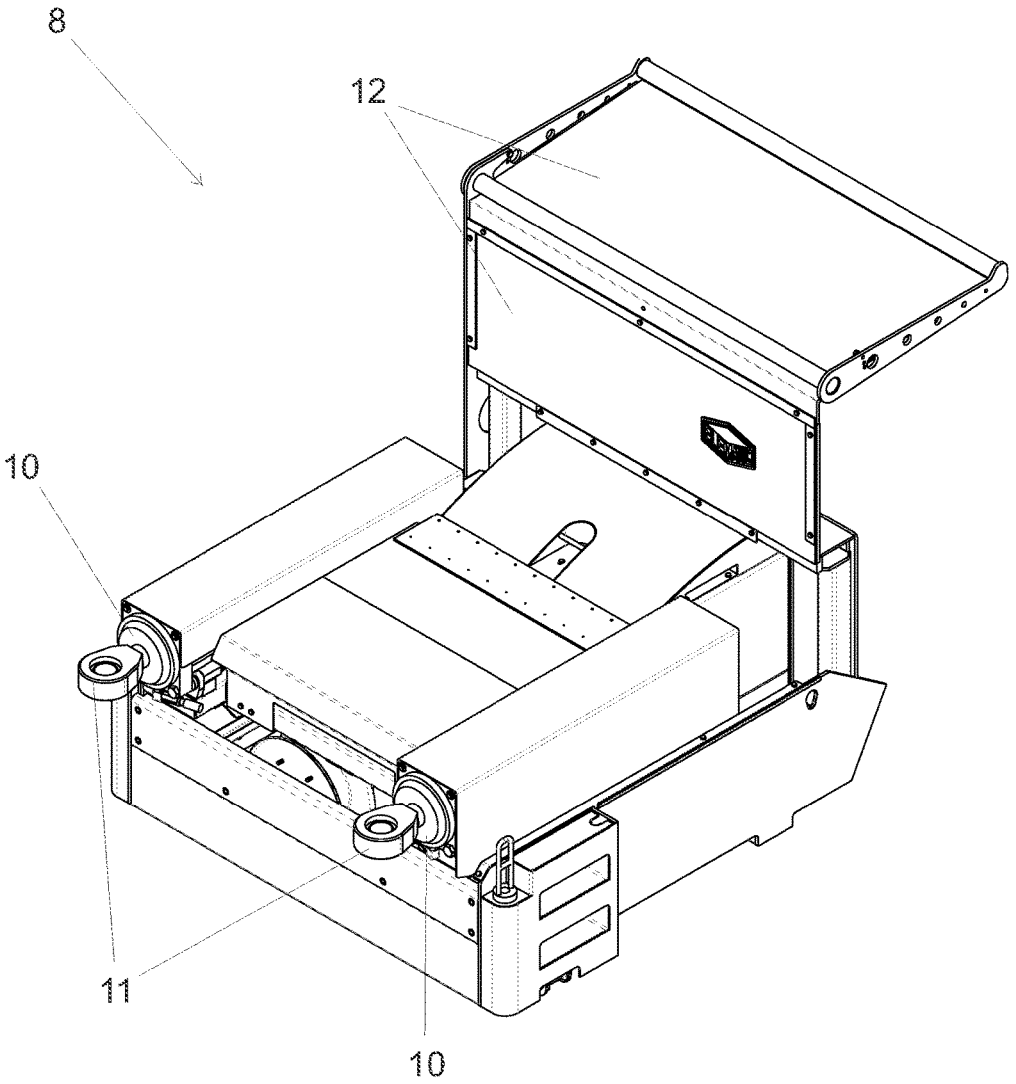
FIG. 2 shows schematically a bundle stressing device of an embodiment of the present invention.

FIG. 2 shows schematically a bundle stressing device 8 of an embodiment of the present invention.

The bundle stressing device 8 comprises two hydraulic cylinders 10 used for pulling the strand bundle plate (not shown) connected to the shafts 11 of the hydraulic cylinders. The operator of the bundle stressing device is located behind protective cover 12.

The force exerted by the hydraulic cylinders 10 ($F_s$) is determined, based on measured hydraulic pressure in the cylinders, the amount of hydraulic cylinders implementing the stressing process, and the cross-sectional hydraulic area of the hydraulic cylinders (surface area of the piston deducted with cross-sectional area of the piston shaft), for example. The distance pulled with the hydraulic cylinders is also measured, with distance sensors (not shown) for example. The distance pulled (ΔL) is used to observe the behavior of the force during the pulling process in relation to the distance pulled. These measurements and the determination of the force exerted are advantageously carried out with an automatic control system (not shown) of the bundle stressing device 8, based on implementation of Hooke's law.

In some embodiments each of the hydraulic cylinders 10 may be driven though separate valves, or with equalizing device, wherein the actual pressure within each of the hydraulic cylinders may vary. In these types of embodiments the mean value of the hydraulic cylinder pressures may be used in the determination of the force exerted by the hydraulic cylinders 10. The automatic control system of the bundle stressing device 8 of the invention may also compare the pressures of each of the hydraulic cylinders 10, and issue an alert if the pressure in one of the hydraulic cylinders deviates more than a preset maximum deviation value from the other.

The automatic control system of the bundle stressing device 8 is advantageously connected to a production control system of the manufacturing facility, so that information about the amount and type of the reinforcement strands in a bundle can be provided to the automatic control system for the determination of the expected stress behavior of the reinforcement strand bundle during the stressing process.

Figure 3:
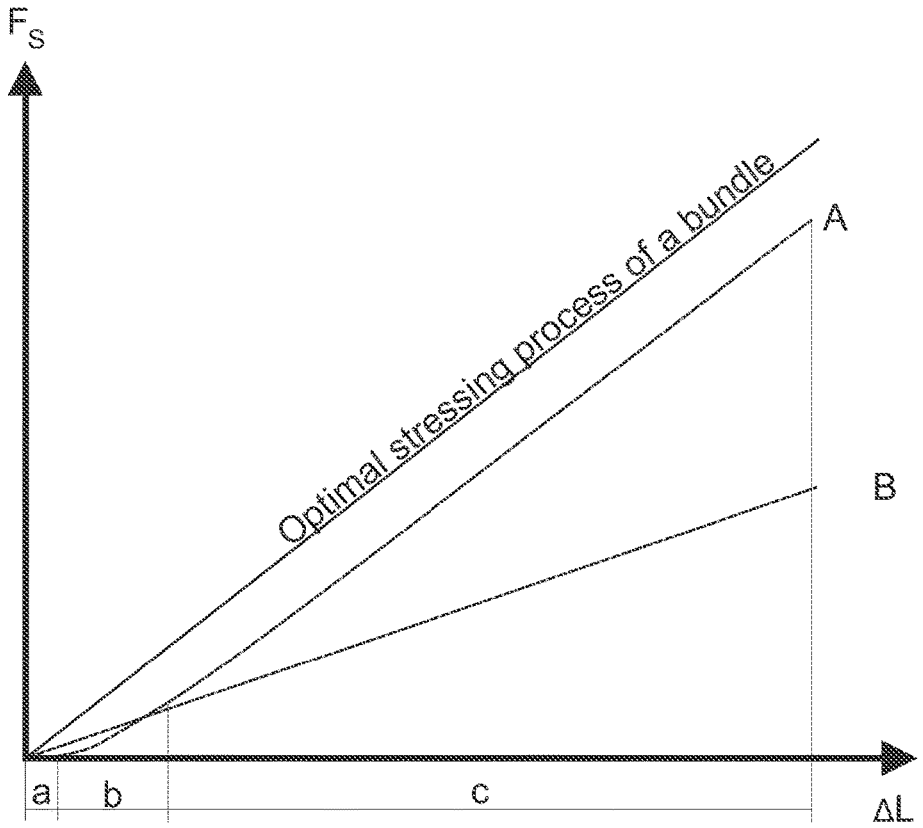
FIG. 3 shows schematically one principle for following and controlling stressing process based on Hooke's law as a graph.

FIG. 3 shows schematically one principle for following and controlling stressing process based on Hooke's law as a graph.

In FIG. 3, the force $F_s$ is the force exerted by hydraulic cylinders 10 of the bundle stressing device 8, and can be defined by equation:

$F_s = pA$, where p=the pressure of the hydraulic fluid in cylinders, and

A=cross-sectional area of the hydraulic fluid area of the cylinders (surface area of the piston deducted with cross-sectional area of the piston shaft and multiplied with the amount of cylinders)

In FIG. 3, the elongation ΔL is the obtained elongation of the reinforcement strand bundle during the stressing process, which can be defined by measuring the movement of the strand pulling plate connected to the strand stressing device during the stressing process. The elongation ΔL can also be used to determining the force affecting the stressed reinforcement strands with equation:

$F = (\Delta LAE)/L$, where

ΔL=obtained elongation,

A=combined cross-sectional area of the reinforcement strands in the bundle,

E=modulus of elasticity of the reinforcement strands, and

L=unstressed length of the reinforcement strands.

As shown in FIG. 3 with a continuous line, the optimal bundle stressing process will create a straight line graph when measuring these two above mentioned variables during the strand stressing process. The angular coefficient of the optimal bundle stressing process in the graph of FIG. 3 corresponds to the elastic constant of Hooke's law, and can be predefined based on the type and amount of reinforcement strands in the bundle to be stressed. Thus the line presenting the optimal stressing process for a bundle can be predefined and used as a reference graph for the actual stressing process.

Dashed line A in FIG. 3 shows an example of a graph for measured stressing process of a bundle, where at start there were some slack in some of the reinforcement strands and/or there was some sliding of at least some reinforcements strands in their fixing to the strand pulling plate, but the expected stressing process resumed during early stages. This is often acceptable tensioning process, if the following requirements are fulfilled:

a) Deviation from the expected stressing process does not extend over maximum predefined length of the total elongation (ΔL), preferably without the length of phase a. The set maximum may be 5% of the total elongation, for example. There may be also be predefined separate maximum values set for both the length of phase a and the combined length of phases b+c, where exceeding one of the two separate maximum values will lead to unacceptable tensioning process, for example.

b) Required force $F_s$ is obtained at the end of the stressing process.

In the stressing process of dashed line A, during phase a the slack from the reinforcement strands is removed which does not affect the measured force, during phase b the reinforcement strands starts to stress one by one, and during phase c all of the reinforcement strands stress according to the expected stressing process.

Dashed line B in FIG. 3 shows an example of a graph for measured stressing process of a bundle, where the fixing of some of the reinforcement strands have failed, or there are too few reinforcement strands in the bundle.

The comparison of predefined progression of the stressing process to the actual measured progression of the stressing process, as illustrated with reference to FIG. 3, allows for quick indication and thus reaction to problems in the stressing process.

If the phase b extends over the predefined maximum or if the determined force does not reach predetermined force or force range, an alert is issued by the automatic control system of the bundle stressing device and/or release of the stressed reinforcement strands is required. Further, a predefined value is also set to the length of phases b+c, and if the required measured force is not achieved during this length, an alert is issued.

Both ends of a slipform casting bed are often equipped with fixed strand combs which are used to maintain the reinforcement strands at their proper location during the stressing process of the strands and during the slipform casting. These strand combs may create friction during the stressing process of the strands, the effect of which can be taken into account in the stressing process by introducing corresponding coefficients into the calibration process of the strand pulling device, for example. The strand pulling devices are generally calibrated twice a year.

The data obtained from the stressing process is also advantageously saved to the automatic control system, or to external database, so that correct stressing process and correct stressing of reinforcement strands can be checked and proved after casting of the prestressed product for each cast product.

With an embodiment of the present invention is possible to know and guarantee that the stressing of the reinforcement strands is adequate, and that the differences of the stressing of separate reinforcement strands in the bundle is below a preset value (for example, the mentioned 5%).

The specific exemplifying embodiments of the invention shown in figures and discussed above should not be construed as limiting. A person skilled in the art can amend and modify the embodiments in many evident ways within the scope of the attached claims. Thus the invention is not limited merely to the embodiments described above.

The invention claimed is:

1. A method for casting prefabricated prestressed concrete products with a substantially horizontal slipform casting process, the method comprises:

stressing reinforcement strands in a bundle on a casting bed before the slipform casting process is started, predetermining an expected behavior of at least one measurable variable affecting the stressing of the reinforcement strands, during the stressing of the reinforcement strands, comprising predetermining how the at least one measurable variable will evolve and change during the stressing of the reinforcement strands, measuring a behavior of the at least one measurable variable during the stressing of the reinforcement strands, comprising measuring how the at least one measurable variable evolves and changes during the stressing of the reinforcement strands, comparing the measured behavior of the at least one measurable variable to the predetermined expected behavior of the at least one measurable variable during the stressing of the reinforcement strands, and ending the stressing of the reinforcement strands if the measured behaviour deviates from the predetermined expected behaviour by more than a predetermined amount during the stressing of the reinforcement strands.

2. The method according to claim 1, wherein the at least one measurable variable comprises a force exerted during the stressing of the reinforcement strands, an elongation of the reinforcement strands, or any other measurable variable which can be used to determine either the force or the elongation, or a combination thereof.

3. The method according to claim 1, wherein in predetermining the expected behavior of the at least one measurable variable, amount and type of the reinforcement strands in the bundle are used.

4. The method according to claim 1, further comprising controlling the stressing of the reinforcement strands with an automatic control system implementing predetermination of the expected behavior of the at least one measurable variable, or the measuring of the behavior of the at least one measurable variable during the stressing of the reinforcement strands, which automatic control system is a part of a production control system of a manufacturing facility of the prefabricated prestressed concrete products.

5. The method according to claim 4, wherein the automatic control system issues an alert and ends the stressing of the reinforcement strands, releases stress affecting the reinforcement strands in the bundle, or both, when the measured behavior of the at least one measurable variable deviates from the predetermined expected behavior of the at least one measurable variable by more than the predetermined amount during the stressing of the reinforcement strands.

* * * * *